US007784297B2

(12) United States Patent
Otake et al.

(10) Patent No.: US 7,784,297 B2
(45) Date of Patent: Aug. 31, 2010

(54) COOLING HEATING DEVICE

(75) Inventors: Masahisa Otake, Gunma (JP); Koji Sato, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 376 days.

(21) Appl. No.: 11/711,153

(22) Filed: Feb. 27, 2007

(65) Prior Publication Data

US 2007/0234752 A1 Oct. 11, 2007

(30) Foreign Application Priority Data

Feb. 27, 2006 (JP) ..... 2006-050947

(51) Int. Cl.
*F25B 13/00* (2006.01)

(52) U.S. Cl. ..... 62/324.1; 165/62

(58) Field of Classification Search ..... 62/324.1, 62/324.6; 165/62

See application file for complete search history.

(56) References Cited

U.S. PATENT DOCUMENTS

| | | | | |
|---|---|---|---|---|
| 5,987,907 | A * | 11/1999 | Morimoto et al. | 62/212 |
| 6,449,974 | B1 * | 9/2002 | Kampf | 62/244 |
| 2005/0279128 | A1 * | 12/2005 | Otake et al. | 62/512 |
| 2006/0005558 | A1 * | 1/2006 | Otake et al. | 62/260 |

FOREIGN PATENT DOCUMENTS

| | | | |
|---|---|---|---|
| JP | 54-142643 | | 11/1979 |
| JP | 01-285758 | | 11/1989 |
| JP | 02-290476 | | 11/1990 |
| JP | 3-144265 | | 6/1991 |
| JP | 4-131663 | | 5/1992 |
| JP | 2001-091087 | | 4/2001 |
| JP | 2003-074970 | | 3/2003 |
| JP | 2004-309093 | A | 11/2004 |
| JP | 2004-340470 | A | 12/2004 |
| JP | 2005-241216 | | 9/2005 |

OTHER PUBLICATIONS

Japanese Office Action issued in Japanese Patent Application No. 2006-050947, dated Nov. 17, 2009.

* cited by examiner

*Primary Examiner*—Melvin Jones
(74) *Attorney, Agent, or Firm*—McDermott Will & Emery LLP

(57) ABSTRACT

An object of the present invention is to provide a cooling heating device in which a suitable operation can be performed in harmony with fluctuations of cooling and heating loads to reduce energy consumption, and the cooling heating device includes an outdoor heat exchanger having one end connected to a refrigerant outlet-side pipe of a condenser via an expansion valve and having the other end connected to a suction-side pipe and a discharge-side pipe of a compressor and configured to perform heat exchange between a refrigerant and outside air; a changeover valve which executes control so as to pass the refrigerant discharged from the compressor through the condenser or the outdoor heat exchanger and supply the refrigerant from the outdoor heat exchanger to the compressor or supply the refrigerant from the evaporator to the compressor; and a control unit which controls the compressor, the expansion valve and the changeover valve based on a cooling operation signal in response to a cooling load of the cool target and a heating operation signal in response to a heating load of the heat target.

4 Claims, 8 Drawing Sheets

FIG. 3

| | | HEATING OPERATION SIGNAL | | |
|---|---|---|---|---|
| | | NECESSARY | POSSIBLE | IMPOSSIBLE |
| COOLING OPERATION SIGNAL | NECESSARY | SIMULTANEOUS COOLING AND HEATING OPERATION | SIMULTANEOUS COOLING AND HEATING OPERATION | COOING OPERATION |
| | POSSIBLE | SIMULTANEOUS COOLING AND HEATING OPERATION | STOP | STOP |
| | IMPOSSIBLE | HEATING OPERATION | STOP | STOP |

FIG. 4

| | | OPERATION MODE | | |
|---|---|---|---|---|
| | | COOING | HEATING | SIMULTANEOUS COOLING AND HEATING |
| CHANGEOVER VALVE | SV1 | × | ○ | ○ |
| | SV2 | ○ | × | ○ |
| | SV3 | ○ | × | × |
| | SV4 | × | ○ | × |
| | SV5 | × | ○ | ○ |
| EXPANSION VALVE | EV1 | ○ | × | ○ |
| | EV2 | ○ | ○ | × |

○ : OPEN
× : CLOSE

COOLING HEATING DEVICE

BACKGROUND OF THE INVENTION

The present invention relates to a cooling heating device which cools a cool target by heat absorption of a refrigerant in an evaporator of a vapor compression type refrigeration cycle (vapor-compression refrigeration cycle) and which heats a heat target by heat radiation of the refrigerant in a condenser (or condensing heat exchanger or gas cooler or gas cooling heat exchanger).

In general, a freezing device has broadly been used in which a vapor compression type refrigeration cycle is used as a method such as cooling or freezing to cool a cool target. In this type of freezing device, the cool target is cooled by an evaporating function of a refrigerant in an evaporator, and heat generated by condensation of the refrigerant in a condenser is released to atmospheric air or the like.

Moreover, as a method such as heating or hot water supply to heat a heat target, a heat pump device is used in which the vapor compression type refrigeration cycle is used. In this type of heat pump device, the heat target is heated by a heat radiating function in a case where the refrigerant rejects heat to condense in the condenser, and the heat is absorbed from a heat source such as the atmospheric air by evaporation of the refrigerant in the evaporator.

In the above freezing device, during a cooling operation, the heat generated at a time when the refrigerant rejects the heat to condense in the condenser is released to the atmospheric air. Therefore, there has been a problem that energy is not effectively used and that rise of an ambient temperature is incurred.

On the other hand, in the above heat pump device, a heat absorbing function obtained at a time when the refrigerant evaporates in the evaporator during a heat pump operation is not effectively used at all, and the heat is simply pumped up from the atmospheric air.

To solve the problem, a cooling heating device is developed in which the heat rejected (transferred) on a high-pressure side of the refrigeration cycle is effectively used even during the cooling operation, and energy saving is achieved (see, e.g., Japanese Patent Application Laid-Open Nos. 2004-309093 and 2004-340470). In the cooling heating device constituted so that cooling and heating are simultaneously performed using the refrigeration cycle, the cool target is cooled by the evaporating function of the refrigerant in the evaporator of the refrigeration cycle. Moreover, the heat target can be heated by the heat rejected from the refrigerant in the condenser. Therefore, the heat generated on the high-temperature side of the refrigeration cycle in a cooling process, which has heretofore been released into the atmospheric air without being used, can effectively be used, and reduction of consumption of the energy can be expected.

However, the energy consumption can be reduced as described above in a case where the cooling and the heating are simultaneously performed. However, in a case where the cooling operation involving the heat radiation in an outdoor air heat exchanger (an operation in which the only cooling is used) or a heating operation involving the heat absorption in an air heat exchanger (an operation in which the only heating is used) is performed, it cannot be said that the energy is effectively used.

Especially, required cooling and heating loads are not necessarily balanced thermally cyclically, and the respective loads are not necessarily generated at the same time. Therefore, even in the cooling heating device constituted so that the cooling and the heating are simultaneously performed, the cooling operation and the heating operation are not frequently performed at the same time. Therefore, it has actually been difficult to perform an efficient operation.

SUMMARY OF THE INVENTION

The present invention has been developed in order to solve such a conventional technical problem, and an object of the present invention is to provide a cooling heating device in which a suitable operation can be performed in harmony with fluctuations of cooling and heating loads to reduce energy consumption.

A cooling heating device of a first invention is provided with a vapor compression type refrigeration cycle including a refrigerant circuit constituted by successively connecting a compressor, a condenser, throttle means and an evaporator, heats a heat target by use of a heat radiating function of a refrigerant in the condenser and cools a cool target by use of a heat absorbing function of the refrigerant in the evaporator. The device is characterized by comprising: an auxiliary heat exchanger having one end connected to a refrigerant outlet-side pipe of the condenser via the throttle means and having the other end connected to a suction-side pipe and a discharge-side pipe of the compressor and configured to perform heat exchange between the refrigerant and a heat source other than the heat target and the cool target; channel changeover means for executing control so as to pass the refrigerant discharged from the compressor through the condenser or the auxiliary heat exchanger and supply the refrigerant from the auxiliary heat exchanger to the compressor or supply the refrigerant from the evaporator to the compressor; and control means for controlling the compressor, each throttle means and the channel changeover means based on a cooling operation signal in response to a cooling load of the cool target and a heating operation signal in response to a heating load of the heat target.

In the above invention, the cooling heating device of a second invention is characterized by further comprising: heating-side pump means for circulating a heating-side heat medium to perform heat exchange between the condenser and the heating-side heat medium constituting the heat target; heating-side flow rate adjustment means for adjusting a flow rate of the heating-side heat medium; heating-side temperature detection means for detecting a temperature of the heating-side heat medium subjected to the heat exchange between the heating-side heat medium and the condenser; and a heating-side connection port to be connected to a circulation path of the heating-side heat medium.

In the above inventions, the cooling heating device of a third invention is characterized by further comprising: cooling-side pump means for circulating a cooling-side heat medium to perform heat exchange between the evaporator and the cooling-side heat medium constituting the cool target; cooling-side flow rate adjustment means for adjusting a flow rate of the cooling-side heat medium; cooling-side temperature detection means for detecting a temperature of the cooling-side heat medium subjected to the heat exchange between the cooling-side heat medium and the evaporator; and a cooling-side connection port to be connected to a circulation path of the cooling-side heat medium.

The cooling heating device of a fourth invention is characterized in that in the above inventions, the cooling operation signal is a signal indicating one of a state in which the cooling of the cool target in the evaporator is necessary, a state in which the cooling is possible and a state in which the cooling is impossible.

The cooling heating device of a fifth invention is characterized in that in the above inventions, the heating operation signal is a signal indicating one of a state in which the heating of the heat target in the condenser is necessary, a state in which the heating is possible and a state in which the heating is impossible.

According to the present invention, the cool target can be cooled by the heat absorbing function of the refrigerant in the evaporator of the vapor compression type refrigeration cycle. Moreover, the heat target can be heated by the heat radiating function of the refrigerant in the condenser. Therefore, it is possible to effectively use the heat on a high-temperature side of the refrigeration cycle, generated in a cooling process. The heat has heretofore been released to atmospheric air without being used. In consequence, consumption of energy can be reduced.

Especially, when a flow of the refrigerant is switched by the channel changeover means, all of a cooling operation of performing the only cooling of the cool target, a heating operation of performing the only heating of the heat target and a simultaneous cooling and heating operation of simultaneously performing the cooling of the cool target and the heating of the heat target can be realized. Therefore, the device can broadly cope with balance fluctuations of the cooling load or the heating load, and the cooling of the cool target and the heating of the heat target can securely be performed.

Furthermore, according to the present invention, the compressor, each throttle means and the channel changeover means are controlled so as to preferentially perform the simultaneous cooling and heating operation based on the cooling operation signal in response to the cooling load and the heating operation signal in response to the heating load. In consequence, a time to perform the operation of performing the only cooling or heating can be shortened, and a time when the refrigerant discharged from the compressor is passed through the condenser and the refrigerant discharged from the evaporator is sucked into the compressor to perform the simultaneous cooling and heating operation can be lengthened. An efficiency of the cooling heating device can be improved by effectively using the energy.

In addition, according to the present invention, the device can easily be connected to various cooling load facilities and heating load facilities. Therefore, the device has an excellent energy saving property, can further easily be moved and installed and has excellent general-purpose properties. Especially, the device does not have to be connected to the cooling load facility and/or the heating load facility via refrigerant pipes. Therefore, the device in which an appropriate amount of the refrigerant is introduced beforehand can be conveyed to an installation place.

BRIEF DESCRIPTION OF THE DRAWINGS

FIG. 3 is a diagram showing a judgment operation of the operation mode of the cooling heating device shown in FIG. 1;

FIG. 4 is a diagram showing a state of a changeover valve for each operation mode of the cooling heating device shown in FIG. 1;

DETAILED DESCRIPTION OF THE PREFERRED EMBODIMENTS

Embodiments of the present invention will hereinafter be described in detail with reference to the drawings.

Embodiment 1

Figure 1:
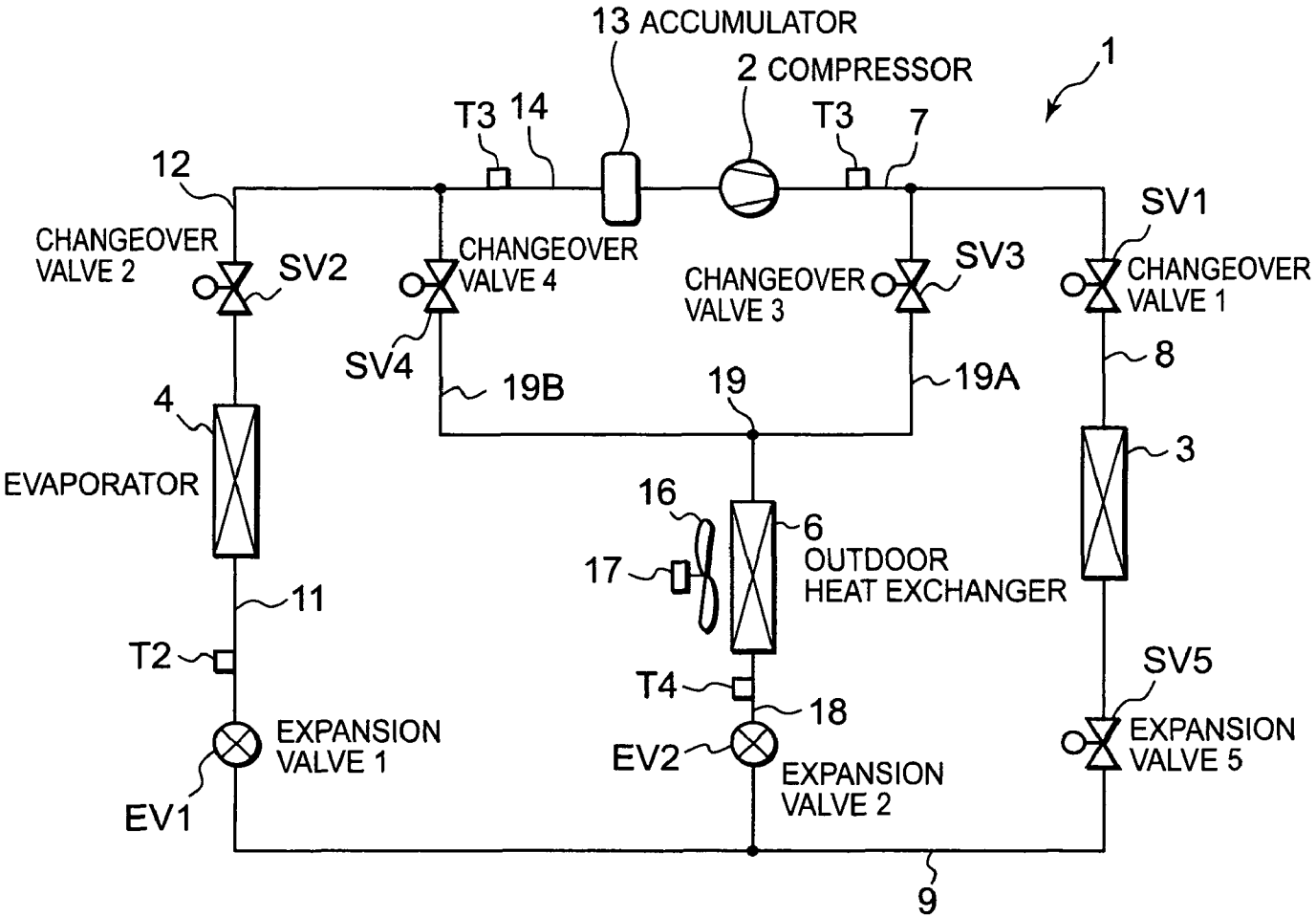
FIG. 1 is a refrigerant circuit diagram showing a cooling heating device according to Embodiment 1 of the present invention.

FIG. 1 shows a refrigerant circuit of a cooling heating device 1 according to Embodiment 1 of the present invention. The cooling heating device 1 of the present embodiment is provided with a vapor compression refrigeration cycle including a refrigerant circuit constituted of a compressor 2; a condenser 3 which heats a heat target by a heat radiating function of a refrigerant; an evaporator 4 which cools a cool target by a heat absorbing function due to evaporation of the refrigerant; an outdoor heat exchanger 6 as an auxiliary heat exchanger which performs heat exchange between the refrigerant and outside air (a heat source other than the heat target and the cool target) to perform heat radiation or heat absorption of the refrigerant and the like.

In this case, a discharge-side pipe 7 of the compressor 2 is connected to a refrigerant inlet-side pipe 8 of the condenser 3 via a changeover valve SV1, a refrigerant outlet-side pipe 9 of the condenser 3 is provided with a changeover valve SV5, and this refrigerant outlet-side pipe 9 is connected to an expansion valve EV1 as throttle means. Moreover, a refrigerant inlet-side pipe 11 of the evaporator 4 is connected to an outlet of this expansion valve EV1, a refrigerant outlet-side pipe 12 of the evaporator 4 is connected to a changeover valve SV2, and an outlet of this changeover valve SV2 is connected to a suction-side pipe 14 of the compressor 2 provided with an accumulator 13 to constitute the refrigerant circuit.

The outdoor heat exchanger 6 is, for example, a so-called tube and fin type heat exchanger constituted of a copper tube and a heat conduction promoting aluminum fin disposed at the copper tube, and has a channel of the refrigerant in the copper tube. The outdoor heat exchanger is also provided with a fan 16 and a fan motor 17 which blow, to the outdoor heat exchanger 6, air (outside air) to be subjected to heat exchange between the air and the refrigerant flowing through the copper tube.

Here, the type of the outdoor heat exchanger 6 is not limited to this example. For example, an aluminum extruded porous flat tube may be used, and holes can be made as channels of the refrigerant in the flat tube (a so-called micro channel heat exchanger).

A refrigerant pipe 18 at one end of this outdoor heat exchanger 6 is connected to the refrigerant outlet-side pipe 9 of the condenser 3 via an expansion valve EV2, a refrigerant pipe 19 at the other end of the outdoor heat exchanger 6 is branched, one branch pipe 19A is connected to the discharge-side pipe 7 of the compressor 2 via a changeover valve SV3, and the other branch pipe 19B is connected to the suction-side pipe 14 of the compressor 2 via a changeover valve SV4.

A discharge temperature sensor T1 (discharge temperature detection means) which detects a temperature of the refrigerant compressed by and discharged from the compressor 2 is attached to the discharge-side pipe 7 of the compressor 2. An evaporation temperature sensor T2 (evaporation temperature detection means) which detects an evaporation temperature of the refrigerant is attached to the refrigerant inlet-side pipe 11 of the evaporator 4 (or a refrigerant pipe disposed in the evaporator 4). A suction temperature sensor T3 (suction temperature detection means) which detects a temperature of the refrigerant sucked into the compressor 2 is attached to the suction-side pipe 14 on an inlet side of the accumulator 13. Furthermore, a temperature sensor T4 (temperature detection means) is attached to the refrigerant pipe 18 between the outdoor heat exchanger 6 and the expansion valve EV2.

Here, carbon dioxide is introduced as the refrigerant in the refrigerant circuit of this vapor compression refrigeration cycle. Therefore, since a refrigerant pressure in the condenser 3 or the like on a high-pressure side sometimes exceeds a critical pressure, the refrigerant cycle is sometimes a transcritical cycle. As a lubricant of the compressor 2, for example, mineral oil, alkyl benzene oil, ether oil, ester oil, polyalkylene glycol (PAG), polyol ether (POE) or the like is used.

Moreover, the cooling heating device 1 of the present embodiment includes a control unit (not shown herein) which controls switching of refrigerant circulation in the refrigerant circuit, starting of an operation of the compressor 2 and stopping of the operation based on a cooling operation signal indicating a state of a cooling load on the cool target and a heating operation signal indicating a state of a heating load on the heat target. The cooling operation signal is one of a "cooling necessary" signal indicating a state in which the cooling of the cool target is necessary, a "cooling possible" signal indicating a state in which the cool target does not have to be cooled immediately but may be cooled and a "cooling impossible" signal indicating a state in which the cool target must not be cooled. The heating operation signal is one of a "heating necessary" signal indicating a state in which the heating of the heat target is necessary, a "heating possible" signal indicating a state in which the heat target does not have to be heated immediately but may be heated and a "heating impossible" signal indicating a state in which the heat target must not be heated.

The cooling operation signal and the heating operation signal may be distinguished and determined by the control unit of the cooling heating device 1 based on a detected temperature value or the like of a load facility (a cooling load facility and a heating load facility) and the like. Alternatively, these signals may be received from a control unit of the cooling load facility or the heating load facility.

Figure 2:
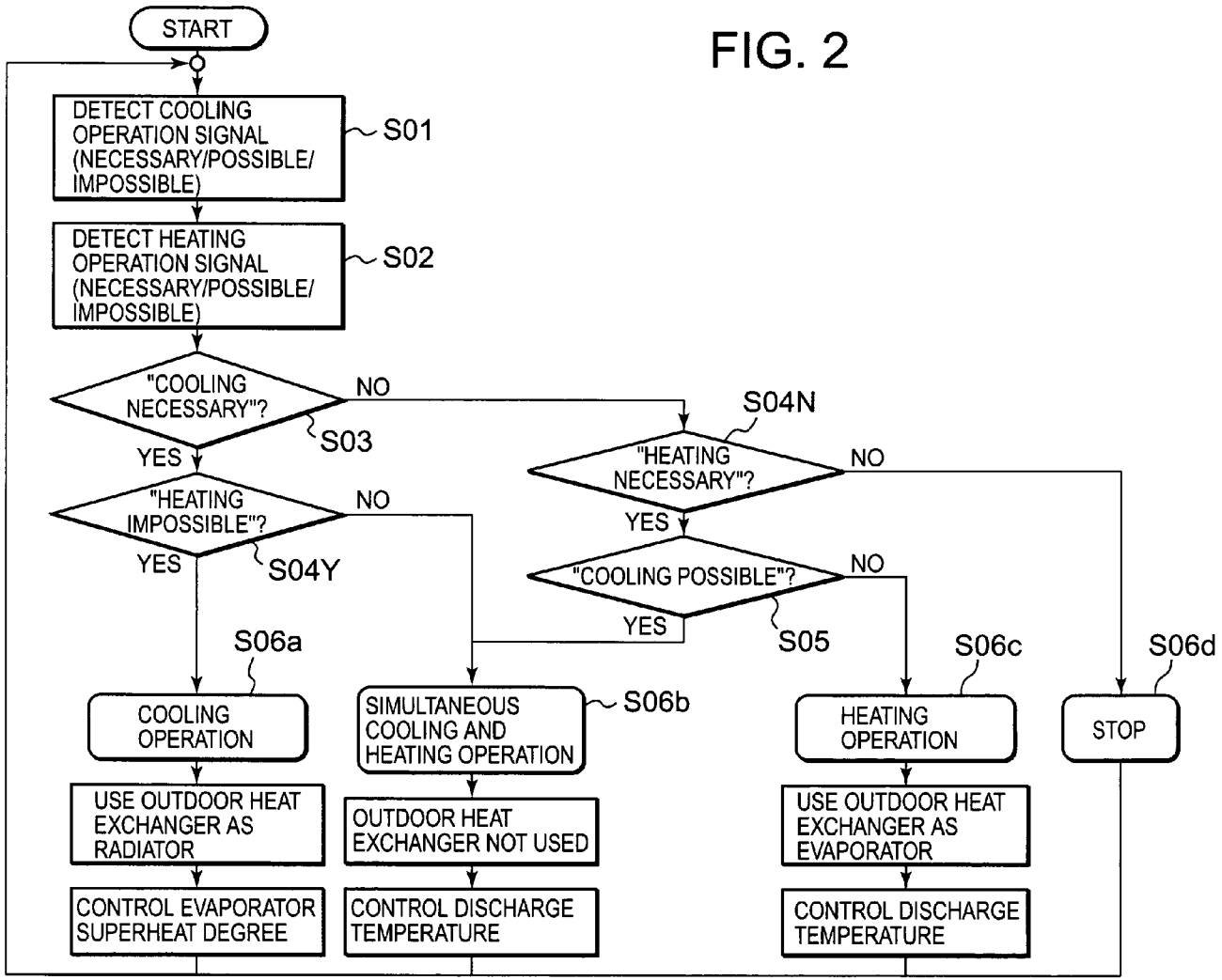
FIG. 2 is a flow chart of control to judge an operation mode of the cooling heating device shown in FIG. 1.

Next, an operation of the cooling heating device 1 of the embodiment will be described with reference to FIGS. 2 to 4. First, the cooling operation signal indicating the state of the cooling load is detected (FIG. 2, S01). As described above, the cooling operation signal indicates one of the three states "cooling necessary", "cooling possible" and "cooling impossible".

Examples of the "cooling necessary" state include a state in which the cool target needs to be cooled immediately in a case where a temperature of the cool target is higher than a predetermined temperature to be kept. Examples of the "cooling impossible" state include a state in which the cool target must not be cooled any more in a case where the cool target has a sufficiently low temperature and reaches a target cooling temperature or a case where freezing and quality deterioration of the cool target are avoided. In a conventional freezing device, ON/OFF control of a freezer has been performed in order to maintain a predetermined temperature range. The "cooling necessary" signal corresponds to an ON signal of the conventional freezer and the "cooling impossible" signal corresponds to an OFF signal.

The "cooling possible" signal indicates the state in which the cool target does not have to be cooled immediately but may be cooled. Examples of this state include a state in a case where the temperature of the cool target is higher than a predetermined lower limit temperature determined from a purpose of maintaining a quality or the like, and lower than an upper limit value. The examples also include a state in which an amount of stored heat does not decrease to such an extent that the cool target needs to be cooled immediately, and does not reach an upper limit of a heating storage capacity in a case where the cooling load is constituted of a heat storage element such as ice storage.

Next, the heating operation signal indicating the state of the heating load is detected (FIG. 2, S02). As described above, the heating operation signal indicates one of the three states "heating necessary", "heating possible" and "heating impossible".

Examples of the "heating necessary" state include a state in which the heating needs to be performed immediately in a case where an amount of stored hot water decreases, and the hot water might be used up in a hot water supply system including a hot water storage tank as the heating load facility. Examples of the "heating impossible" state include a state in which the heating must not be performed any more in a case where the amount of the stored hot water exceeds the maximum amount of the stored hot water determined from a capacity of the hot water storage tank or an required amount of the hot water set in accordance with a use amount of the hot water or the like. In a conventional heat pump hot water supply device, an ON/OFF signal of an operation of an outdoor unit has been sent to the outdoor unit including a refrigeration cycle in consideration of a situation and time period of use of the hot water. The heating operation signal indicating the "heating necessary" state corresponds to an ON signal of the conventional heat pump hot water supply device and the "heating impossible" signal corresponds to an OFF signal.

The "heating possible" signal indicates the state in which the heat target does not have to be heated immediately but may be heated. Examples of this state include a state in which the amount of the hot water does not decrease to such an extent that the hot water is used up, therefore the hot water does not have to be supplied immediately, but the hot water storage tank is not filled with the hot water, and the heating may be performed.

Next, as shown in steps S03 to S06 of FIG. 2, an operation mode of the cooling heating device is determined based on the cooling operation signal and the heating operation signal. Judgment of the operation mode of the steps S03 to S06 of FIG. 2 is shown in a table of FIG. 3. In an only case where one of the cooling operation signal and the heating operation signal indicates the "necessary" state, the operation of the cooling heating device 1 is performed. In another case, the operation is not performed. The cooling operation (the operation of performing the only cooling) is performed in an only case where the cooling operation signal indicates the "necessary" state and the heating operation signal indicates the "impossible" state. The heating operation (the operation of performing the only heating) is performed in an only case where the cooling operation signal indicates the "impossible" state and the heating operation signal indicates the "necessary" state. The simultaneous cooling and heating operation is performed in a case where one of the cooling operation signal and the heating operation signal indicates the "necessary" state and the other signal does not indicates the "impossible" state (the other signal indicates the "necessary" or "possible" state).

Here, in the cooling heating device to simultaneously perform the cooling and the heating, when the operation mode of the device is determined based on the ON/OFF signal (corresponding to the "necessary" signal and the "impossible" signal in the embodiment) on a cooling side and a heating side in response to each load state as in a conventional cooling device, the heat pump device or the like to switch the circuit and start and stop the compressor, a highly efficient operation cannot necessarily be realized.

That is, the simultaneous cooling and heating operation in which energy can effectively be used is performed in an only case where the ON signal is output on both of the cooling side and the heating side. In a case where the ON signal is output on one side and the OFF signal is output on the other side, even if the cooling or the heating may be performed in the other load state, the simultaneous cooling and heating operation is not performed. Specifically, in a case where a heating-side load device is a hot water supply facility including the hot water storage tank and the cooling is necessary on a cooling load side, even if the hot water storage tank is not filled with the hot water and the hot water can be added, the heating is not performed until the ON signal requiring the heating is output from the heating-side load facility. The operation of performing the only cooling is performed, and the heat rejected on the high-pressure side of the refrigerant circuit during the cooling operation is not effectively used, and is discharged from the outdoor heat exchanger to the outside air.

On the other hand, in the cooling heating device 1 of the present embodiment, even in a case where one of the cooling operation signal and the heating operation signal indicates the "necessary" state but the other signal does not indicate the "necessary" state, if the other signal indicates the "possible" state, the simultaneous cooling and heating operation is preferentially performed. In consequence, energy consumption can be reduced. Especially, when the cooling or heating load facility includes the heat storage element, a large effect can be expected.

Next, when the operation mode is determined in the above steps based on the cooling operation signal and the heating operation signal, the operation of the refrigeration cycle of the cooling heating device 1 is performed in accordance with the operation mode. An opened/closed state of each changeover valve in each operation mode is shown in FIG. 4.

(Cooling Operation)

When the cooling operation signal indicates the "necessary" state and the heating operation signal indicates the "impossible" state, the control unit performs the cooling operation of the cooling heating device 1. During this cooling operation, the control unit opens the changeover valves SV2 and SV3 and the expansion valves EV1 and EV2, and closes the changeover valves SV1, SV4 and SV5. This constitutes a refrigeration cycle in which the refrigerant successively passes through the compressor 2, the discharge-side pipe 7, the changeover valve SV3, the outdoor heat exchanger 6, the expansion valve EV2, the expansion valve EV1, the evaporator 4, the changeover valve SV2, the accumulator 13 and the suction-side pipe 14 to return to the compressor 2.

When the cooling operation is started, the refrigerant is compressed by the compressor 2 to obtain a high temperature and a high pressure, and discharged to the discharge-side pipe 7. Subsequently, the refrigerant reaches the outdoor heat exchanger 6, and releases the heat to the air (the outside air) to obtain a low temperature. It is to be noted that carbon dioxide is introduced as the refrigerant in the refrigerant circuit. When an outside air temperature is high, the refrigerant pressure in the outdoor heat exchanger 6 equals or exceeds a critical pressure. Therefore, in this case, condensation of the refrigerant does not occur in the outdoor heat exchanger 6. As the refrigerant rejects the heat to the outside air, the temperature of the refrigerant drops from an inlet to an outlet of the outdoor heat exchanger 6. On the other hand, when the outside air temperature is low, the pressure of the refrigerant circuit on the high-pressure side is not more than the critical pressure in some case. In this case, the refrigerant condenses in the outdoor heat exchanger 6.

Moreover, the low-temperature high-pressure refrigerant exiting from the outdoor heat exchanger 6 is throttled by the expansion valve EV2 or EV1, expands to obtain a low pressure, and reaches the evaporator 4. Here, the refrigerant has a two-phase mixed state in which a liquid refrigerant and a vapor refrigerant are mixed. In the evaporator 4, the liquid-phase refrigerant evaporates to form the vapor refrigerant. The cool target is cooled by the heat absorbing function as this refrigerant evaporates. It is considered that examples of the cool target include food and beverage needed to be cooled and insulated, air in a case where air conditioning is performed, water in a system in which heat conveyance and heat storage are used, brine and ice.

Subsequently, the refrigerant is passed through the suction-side pipe 14 from the evaporator 4, and sucked into the compressor 2 again. The cool target is cooled by a function of the above continuous refrigeration cycle.

During the cooling operation, an open degree of the expansion valve EV1 or EV2 is controlled so that a difference between a sucked refrigerant temperature detected by the suction temperature sensor T3 attached to the suction-side pipe 14 positioned on the inlet side of the accumulator 13 and an evaporation temperature of the refrigerant detected by the evaporation temperature sensor T2 attached to the refrigerant inlet-side pipe 11 of the evaporator 4 or the refrigerant pipe in the evaporator 4, a so-called superheat degree indicates a predetermined value. Specifically, when the superheat degree is larger than the predetermined value, the open degree of the expansion valve is enlarged. Conversely, when the superheat degree is smaller than the predetermined value, the open degree of the expansion valve is reduced. In consequence, an amount of the refrigerant in the evaporator 4 can appropriately be adjusted. As a result, a thermal performance of the evaporator 4 improves, and a highly efficient cooling operation can be performed.

(Heating Operation)

Next, when the cooling operation signal indicates the "impossible" state and the heating operation signal indicates the "necessary" state, the control unit performs the heating operation of the cooling heating device 1. During this heating operation, the control unit opens the changeover valves SV1, SV4 and SV5 and the expansion valve EV2, and closes the changeover valves SV2 and SV3 and the expansion valve EV1. This constitutes a refrigeration cycle in which the refrigerant successively passes through the compressor 2, the discharge-side pipe 7, the changeover valve SV1, the condenser 3, the changeover valve SV5, the expansion valve EV2, the outdoor heat exchanger 6, the changeover valve SV4, the accumulator 13 and the suction-side pipe 14 to return to the compressor 2.

When the heating operation is started, the refrigerant is compressed by the compressor 2 to obtain a high temperature and a high pressure, and discharged to the discharge-side pipe 7. During this heating operation, since the heat target needs to be heated at a high temperature, the refrigerant usually has a supercritical pressure in this state. Subsequently, the refrigerant reaches the condenser 3, and releases the heat to the heat target in the condenser. The refrigerant itself has a low temperature. Here, the refrigerant usually has a liquid-phase state at a critical pressure or more. The heat target is heated by the heat radiating function of the refrigerant in this condenser 3. Examples of the heat target include water in the hot water supply load facility, indoor air in a heating device and a heat medium for heat conveyance.

It is to be noted that carbon dioxide is introduced as the refrigerant in the refrigerant circuit, and the refrigerant pressure in the condenser 3 is not less than the critical pressure in many cases. Therefore, the condensation of the refrigerant does not occur in the condenser 3. As the refrigerant rejects the heat to the heat target, the temperature of the refrigerant drops from an inlet to an outlet of the condenser 3. On the other hand, in the condenser 3, the temperature of the heat target rises from an inlet to an outlet of a channel of the heat target as the heat is absorbed from the refrigerant. Therefore, according to a constitution in which flow directions of the refrigerant and the heat target in the condenser 3 are opposed to each other, highly efficient heat exchange can be performed and the heat target can be heated at the high temperature as compared with an HFC-based refrigerant which performs condensing radiation at a constant temperature.

Moreover, the low-temperature high-pressure refrigerant exiting from the condenser 3 is throttled by the expansion valve EV2, expands to obtain a low pressure, and reaches the outdoor heat exchanger 6. Here, the refrigerant has a two-phase mixed state in which the liquid refrigerant and the vapor refrigerant are mixed. In the outdoor heat exchanger 6, the liquid-phase refrigerant evaporates to form the vapor refrigerant. The refrigerant absorbs the heat from the outside air by an evaporating function of this refrigerant.

Subsequently, the refrigerant is passed through the suction-side pipe 14 from the outdoor heat exchanger 6, and sucked into the compressor 2 again. The heat target is heated by a function of the above continuous refrigeration cycle.

During the heating operation, the control unit adjusts the open degree of the expansion valve EV2 so that a temperature of the discharged refrigerant detected by the discharge temperature sensor T1 attached to the discharge-side pipe 7 of the compressor 2 indicates a predetermined value. Specifically, when the refrigerant temperature detected by the discharge temperature sensor T1 is higher than the predetermined value, the open degree of the expansion valve EV2 is enlarged. Conversely, when the refrigerant temperature detected by the discharge temperature sensor T1 is lower than the predetermined value, the open degree of the expansion valve EV2 is reduced. In consequence, a highly efficient operation can be performed on conditions suitable for the heating operation for a purpose of heating the heat target.

(Simultaneous Cooling and Heating Operation)

When one of the cooling operation signal and the heating operation signal indicates the "necessary" state and the other signal does not indicate the "impossible" state, the simultaneous cooling and heating operation is performed. During this simultaneous cooling and heating operation, the control unit opens the changeover valves SV1, SV2 and SV5 and the expansion valve EV1, and closes the changeover valves SV3 and SV4 and the expansion valve EV2. In consequence, a refrigeration cycle is constituted in which the refrigerant successively passes through the compressor 2, the discharge-side pipe 7, the changeover valve SV1, the condenser 3, the changeover valve SV5, the expansion valve EV1, the evaporator 4, the changeover valve SV2, the accumulator 13 and the suction-side pipe 14 to return to the compressor 2.

When this simultaneous cooling and heating operation is started, the refrigerant is compressed by the compressor 2 to obtain a high temperature and a high pressure, and discharged to the discharge-side pipe 7. During the simultaneous cooling and heating operation, since the heat target needs to be heated at the high temperature, the refrigerant usually has a supercritical pressure in this state. Subsequently, the refrigerant reaches the condenser 3, and releases the heat to the heat target in this condenser to obtain a low temperature. Here, the refrigerant usually has a liquid-phase state at a critical pressure or more. The heat target is heated by the heat radiating function of the refrigerant in this condenser 3. Examples of the heat target include the water in the hot water supply load facility, the indoor air in the heating device and the heat medium for the heat conveyance.

It is to be noted that carbon dioxide is introduced as the refrigerant in the refrigerant circuit, and the refrigerant pressure in the condenser 3 is not less than the critical pressure in many cases. Therefore, the condensation of the refrigerant does not occur in the condenser 3. As the refrigerant rejects the heat to the heat target, the temperature of the refrigerant drops from the inlet to the outlet of the condenser 3. On the other hand, in the condenser 3, the temperature of the heat target rises from the inlet to the outlet of the channel of the heat target as the heat is absorbed from the refrigerant. Therefore, according to the constitution in which the flow directions of the refrigerant and the heat target in the condenser 3 are opposed as described above, the highly efficient heat exchange can be performed and the heat target can be heated at the high temperature as compared with the HFC-based refrigerant which performs condensing radiation at the constant temperature.

Moreover, the low-temperature high-pressure refrigerant exiting from the condenser 3 is throttled by the expansion valve EV1, expands to obtain a low pressure, and reaches the evaporator 4. Here, the refrigerant has a two-phase mixed state in which the liquid refrigerant and the vapor refrigerant are mixed. In the evaporator 4, the liquid-phase refrigerant evaporates to form the vapor refrigerant. The cool target is cooled by the heat absorbing function as this refrigerant evaporates. It is considered that the examples of the cool target include the food and beverage needed to be cooled and insulated, the air in a case where the air conditioning is performed, the water in a system in which M heat conveyance and heat storage are used, the brine and the ice.

Subsequently, the refrigerant is passed through the suction-side pipe 14 from the evaporator 4, and sucked into the compressor 2 again. The cool target is cooled and the heat target is simultaneously heated by the function of the above continuous refrigeration cycle.

During this simultaneous cooling and heating operation, the open degree of the expansion valve EV1 is adjusted so that the temperature of the discharged refrigerant detected by the discharge temperature sensor T1 attached to the discharge-side pipe 7 of the compressor 2 indicates a predetermined value. Specifically, when the refrigerant temperature detected by the discharge temperature sensor T1 is higher than the predetermined value, the open degree of the expansion valve EV1 is enlarged. Conversely, when the refrigerant temperature detected by the discharge temperature sensor T1 is lower than the predetermined value, the open degree of the expansion valve EV1 is reduced. In consequence, the highly efficient operation can be performed on conditions suitable for the simultaneous cooling and heating operation which requires the heating of the heat target.

In each operation mode described above, the number of rotations of the compressor 2 being operated may be constant, but a frequency may be adjusted by an inverter or the like in accordance with the cooling load, the heating load or outside air conditions. In the embodiment, the cooling operation signal is divided into three states, that is, the "cooling necessary", "cooling possible" and "cooling impossible" states. Moreover, the heating operation signal is also divided into three states, that is, the "heating necessary", "heating possible" and "heating impossible" states. The present invention is not limited to this example. One of the cooling operation signal and the heating operation signal may be divided into three states, and the other signal may be divided into two states (the conventional ON/OFF signals). In this case, when the operation signal is divided into two states, it is assumed that the ON signal corresponds to the "necessary" signal, and the OFF signal corresponds to the "impossible" signal. In FIG. 3, a column of the "possible" signal is ignored in determining the operation mode.

As described above, in this embodiment, the cool target is cooled by the heat absorbing function involving the evaporation of the refrigerant in the evaporator 4 of the refrigerant circuit. Moreover, the heat target can be heated by the heat radiating function of the refrigerant in the condenser 3. Therefore, the heat generated on the high-temperature side of the refrigeration cycle in a cooling process, which has heretofore been released into the atmospheric air without being used, can effectively be used, and the energy consumption can be reduced.

Furthermore, when the refrigerant circuit is switched by the changeover valves, the cooling operation of performing the only cooling of the cool target, the heating operation of performing the only heating of the heat target or the simultaneous cooling and heating operation of simultaneously performing the cooling of the cool target and the heating of the heat target can be performed. Therefore, the device can broadly cope with changes of the cooling load or the heating load, and the cooling and the heating can securely be performed.

In addition, the control unit of the cooling heating device 1 of the present embodiment determines a preferable operation mode so as to preferentially perform the simultaneous cooling and heating operation based on the cooling operation signal in response to the cooling load and the heating operation signal in response to the heating load. In consequence, an energy consumption efficiency improves, and the energy can effectively be used.

Embodiment 2

Next, Embodiment 2 of a cooling heating device 1 according to the present invention will be described with reference to FIGS. 5 and 6. This embodiment shows one example of a unit constitution of the cooling heating device 1. The cooling heating device 1 of this embodiment is common to Embodiment 1 described above in many respects. Therefore, detailed description of a constitution to produce a function or an effect which is the same as or similar to that of the cooling heating device 1 of Embodiment 1 is omitted.

Figure 5:
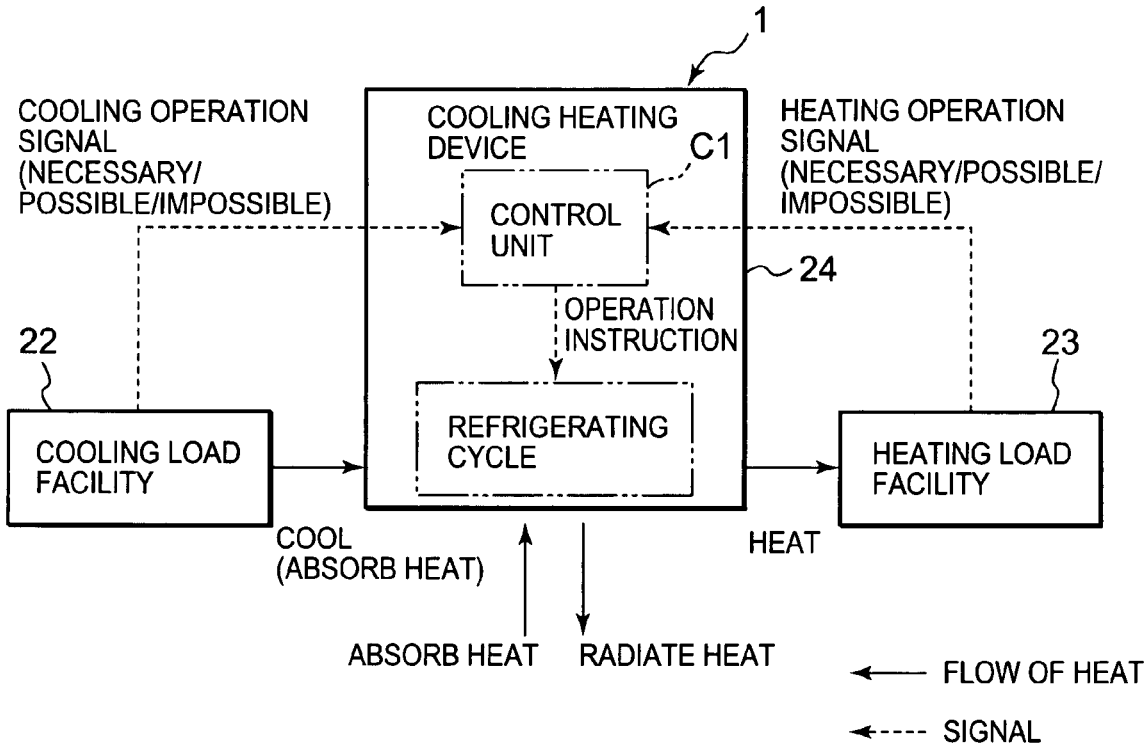
FIG. 5 is a schematic device constitution diagram showing a cooling heating device according to Embodiment 2 of the present invention.

FIG. 5 shows a schematic device constitution of this embodiment. In the cooling heating device 1 of this embodiment, a refrigerant circuit (with the proviso that an evaporator 4 is excluded) of a vapor compression refrigeration cycle to perform cooling and heating, and a control unit C1 which controls an operation of the cooling heating device 1 based on a cooling operation signal from a cooling load facility 22 and a heating operation signal from a heating load facility 23 are installed on one base to constitute a cooling heating unit 24.

Figure 6:
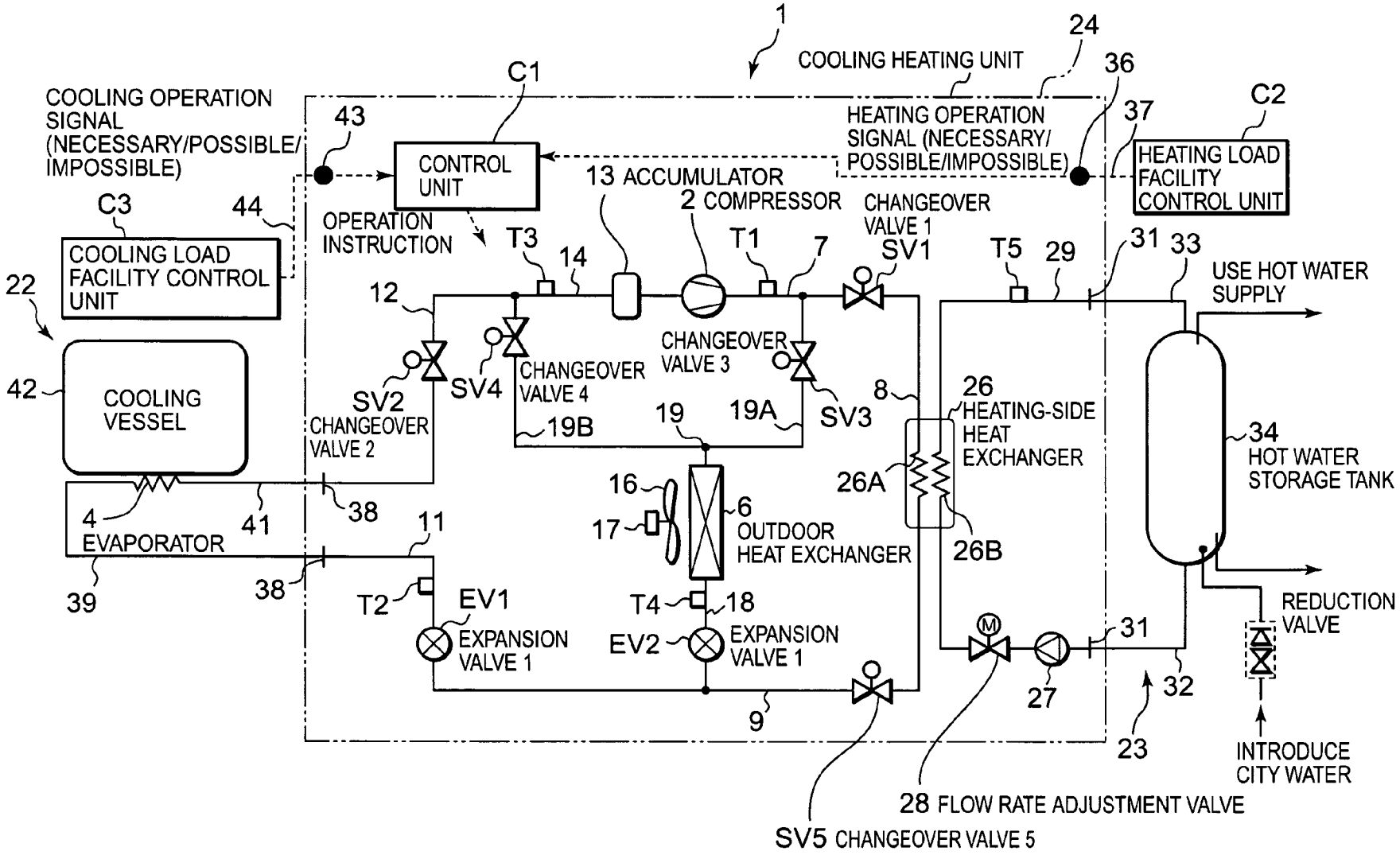
FIG. 6 is a circuit constitution diagram of the cooling heating device shown in FIG. 5.

FIG. 6 shows a circuit diagram of the cooling heating device 1 of Embodiment 2. The cooling heating device 1 of this embodiment is constituted of one cooling heating unit 24 installed on one base, and includes a compressor 2; expansion valves EV1 and EV2 as throttle means; a heating-side heat exchanger 26 which performs heat exchange between a refrigerant and a heating-side heat medium (water in the embodiment) flowing through a circulation path 29; an outdoor heat exchanger 6 which performs heat exchange between the refrigerant and outside air as a heat source; a circulation pump 27 as heating-side pump means which is disposed at the circulation path 29 and which supplies the heating-side heat medium to the heating-side heat exchanger 26; a flow rate adjustment valve 28 as heating-side flow rate adjustment means for adjusting a flow rate of the heating-side heat medium; a heating-side temperature sensor T5 (heating-side temperature detection means) which detects a temperature of the heating-side heat medium subjected to the heat exchange between the medium and the refrigerant in the heating-side heat exchanger 26; and the control unit C1 which controls an operation and stopping of the cooling heating device 1 including the compressor 2 and switching of a refrigerant circulation circuit by changeover valves based on the cooling operation signal in response to a cooling load and the heating operation signal in response to a heating load.

The heating-side heat exchanger 26 corresponds to the condenser 3 of Embodiment 1, and a channel 26A of the refrigerant and a channel 26B of the heating-side heat medium are bonded so that heat exchange is performed and flow directions are opposed to each other. Examples of the heat exchanger include a counterflow type double-tube heat exchanger and a bonded copper tube type heat exchanger.

The cooling heating unit 24 is provided with heating-side pipe connection ports 31, 31 (heating-side connection ports) at opposite ends of the circulation path 29. The heating-side pipe connection ports 31, 31 are connected to a heating-side pipe 32 (a circulation path of the heating-side heat medium) which supplies the heating-side heat medium from the heating load facility 23, and a heating-side pipe 33 (a circulation path of the heating-side heat medium) which supplies the heat medium heated by the cooling heating device 1 to the heating load facility 23. In this embodiment, a hot water supply facility including a hot water storage tank 34 is connected as the heating load facility 23. Therefore, the above heating-side heat medium is water.

Moreover, the heating load facility 23 includes a heating-side control unit C2 (heating-side signal output means) which detects a state of the heating load and which outputs the heating operation signal indicating one of a "heating necessary" state, a "heating possible" state and a "heating impossible" state. The cooling heating unit 24 includes a heating operation signal connection terminal 36, and the terminal 36 is connected to a heating operation signal wiring line 37 from the heating load facility 23.

Furthermore, the cooling heating unit 24 includes refrigerant pipe connection ports 38, 38. The refrigerant pipe connection ports 38, 38 are connected to a refrigerant pipe 39 which supplies, to the cooling load facility 22, the refrigerant throttled and expanded by the expansion valve EV1, and a refrigerant pipe 41 which returns, to the cooling heating device 1, the refrigerant subjected to heat exchange between the refrigerant and a cool target and evaporated in an evaporator 4 disposed in the cooling load facility 22. These pipes are not included in the cooling heating unit 24 of this embodiment, but constitute a part of the cooling heating device 1.

In addition, a cooling vessel 42 in which the cool target is stored and which performs cooling and cold storage is connected as the cooling load facility 22 in this embodiment. Examples of the cool target include beverage such as milk. This cooling vessel 42 is provided with the evaporator 4 so as to perform the heat exchange, and the cooling vessel 42 is cooled by a heat absorbing function of the refrigerant evaporated in the evaporator 4.

Moreover, the cooling load facility 22 includes a cooling-side control unit C3 (cooling-side signal output means) which detects a state of the cooling load and which outputs a cooling operation signal indicating one of a "cooling necessary" state, a "cooling possible" state and a "cooling impossible" state. The cooling heating unit 24 includes a cooling operation signal connection terminal 43, and this terminal 43 is connected to a cooling operation signal wiring line 44 from the cooling load facility 22.

Operations of the cooling heating device 1 of this embodiment, that is, determination of an operation mode based on the cooling operation signal and the heating operation signal and the switching of the refrigerant circuit, and a flow, the heat absorbing function and a heat radiating function of the refrigerant are common to those of Embodiment 1 described above. Therefore, detailed description thereof is omitted. An only operation of the heating-side heat medium as a heat target will be described.

During a heating operation and a cooling and heating operation, the control unit C1 drives the circulation pump 27. In consequence, the water as the heating-side heat medium is taken from a lower portion of the hot water storage tank 34, and sent to the heating-side heat exchanger 26. After a temperature of the water is raised by the heat absorbing function of the refrigerant in the heating-side heat exchanger 26, the water (the hot water) is returned into the hot water storage tank 34 from the upper portion of the hot water storage tank 34.

Here, the control unit C1 detects the temperature of the water subjected to the heat exchange between the water and the heating-side heat exchanger 26 by the heating-side temperature sensor T5, and controls an open degree of the flow rate adjustment valve 28 so that the detected temperature indicates a predetermined value. Specifically, when the detected raised temperature is lower than the predetermined value, the open degree of the flow rate adjustment valve 28 is reduced. Conversely, when the detected raised temperature is higher than the predetermined value, the open degree of the flow rate adjustment valve 28 is enlarged. In consequence, the hot water having a required temperature can be stored in the hot water storage tank 34.

As described above, in the cooling heating device 1 of this embodiment, the refrigerant circuit except the evaporator 4 and the control unit C1 which controls the operation of the cooling heating device 1 based on the cooling operation signal from the cooling load facility 22 and the heating operation signal from the heating load facility 23 are installed on one base to constitute one cooling heating unit 24. Therefore, various cooling load facilities and heating load facilities can easily be connected. In consequence, the cooling heating device 1 of the present embodiment also has characteristics that the device has an excellent energy saving property, is further easily moved and installed and has excellent general-purpose properties in the same manner as in Embodiment 1.

Embodiment 3

Figure 7:
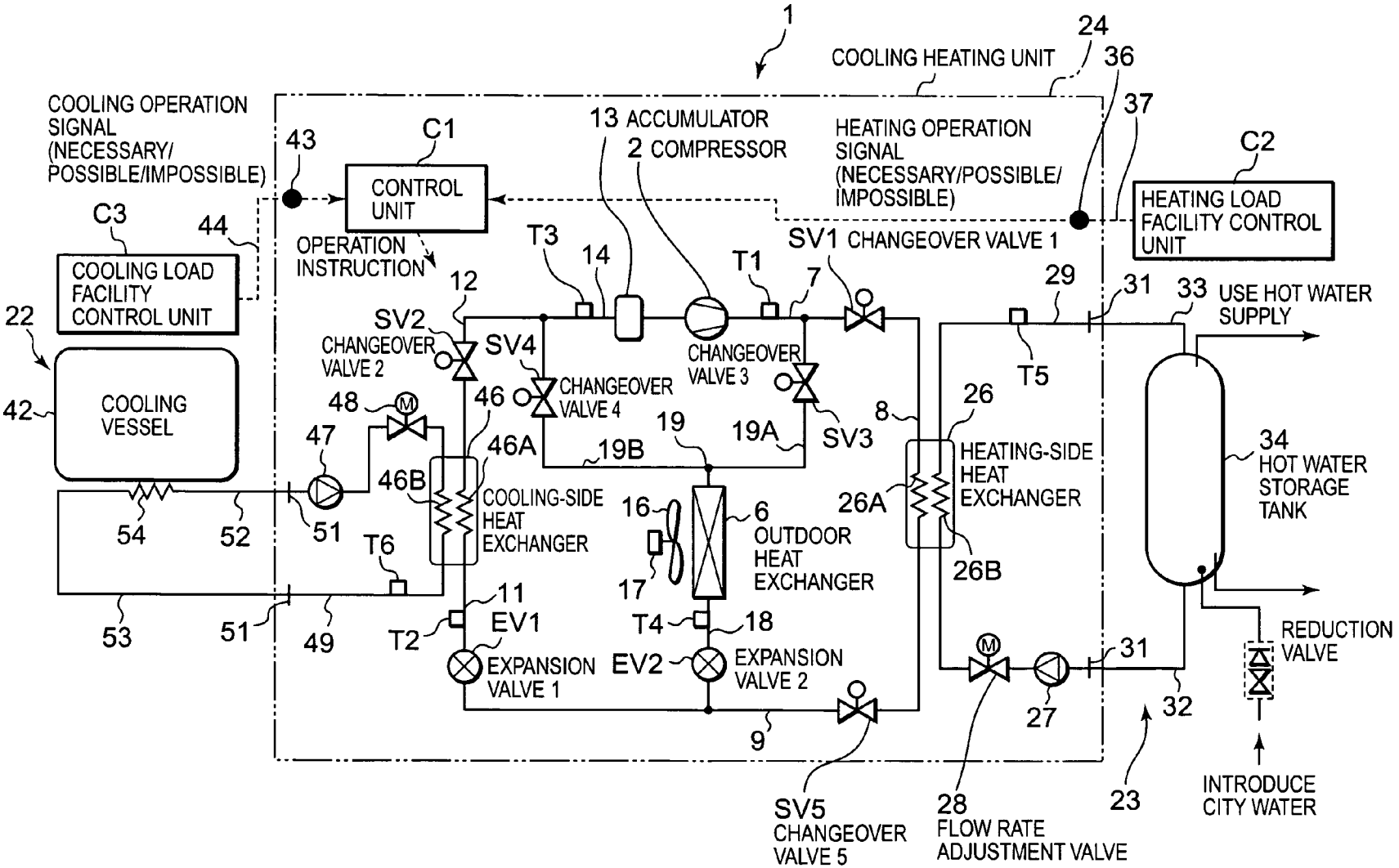
FIG. 7 is a circuit constitution diagram of a cooling heating device according to Embodiment 3 of the present invention.

Next, FIG. 7 shows a circuit diagram of a cooling heating device 1 according to Embodiment 3 of the present invention. This embodiment is one example of another configuration of a unit constitution in the cooling heating device 1. The cooling heating device 1 of this embodiment is common to Embodiment 2 described above in many respects. Therefore, detailed description of a constitution to produce a function or an effect which is the same as or similar to that of the cooling heating device 1 of Embodiment 2 is omitted.

In addition to the unit constitution of Embodiment 2, a cooling heating unit 24 of Embodiment 3 includes a cooling-side heat exchanger 46 to perform heat exchange between a refrigerant and a cooling-side heat medium of a circulation path 49 through which the cooling-side heat medium flows; a circulation pump 47 as cooling-side pump means for supplying the cooling-side heat medium; a flow rate adjustment valve 48 as cooling-side flow rate adjustment means for adjusting a flow rate of the cooling-side heat medium; and a cooling-side temperature sensor T6 which detects a temperature of the cooling-side heat medium subjected to between the medium and the refrigerant in the cooling-side heat exchanger 46.

The cooling-side heat exchanger 46 corresponds to the evaporator 4 of Embodiments 1 and 2 in a refrigerant circuit. A channel 46A of the refrigerant and a cooling-side heat medium channel 46B are bonded so that heat exchange is performed and flow directions are opposed to each other. Examples of the heat exchanger include a counterflow type double-tube heat exchanger, a bonded copper tube type heat exchanger and a plate type heat exchanger. In this embodiment, the above components constitute one cooling heating unit installed on one base.

The cooling heating unit 24 is provided with cooling-side pipe connection ports 51, 51 (cooling-side connection ports) at opposite ends of the circulation path 49. The cooling-side pipe connection ports 51, 51 are connected to a cooling-side pipe 52 (a circulation path of the cooling-side heat medium) which supplies the cooling-side heat medium from a cooling load facility 22, and a cooling-side pipe 53 (a circulation path of the cooling-side heat medium) which supplies the heat medium cooled by the cooling heating device 1 to the cooling load facility 22. A cooler 54 disposed so as to have a heat exchange relation with a cooling vessel 42 is connected between these pipes 52 and 53. It is considered that examples of the cooling-side heat medium include water and brine.

During a cooling operation and a cooling heating operation by the control unit C1, the circulation pump 47 is driven. In consequence, the cooling-side heat medium is sent to the cooling-side heat exchanger 46. The cooling-side heat medium is cooled by a heat absorbing function involving evaporation of the refrigerant flowing through the channel 46A in the channel 46B of the cooling-side heat exchanger 46. Subsequently, the medium is returned to the cooling load facility 22.

The control unit C1 detects the temperature of the cooling-side heat medium subjected to the heat exchange in the cooling-side heat exchanger 46 by the cooling-side temperature sensor T6, and controls an open degree of the flow rate adjustment valve 48 so that the detected temperature indicates a predetermined value. Specifically, when the detected temperature is lower than the predetermined value, the open degree of the flow rate adjustment valve 48 is reduced. Conversely, when the detected temperature is higher than the predetermined value, the open degree of the flow rate adjustment valve 48 is enlarged. In consequence, the cooling-side heat medium is cooled at a required temperature. The cooled cooling-side heat medium exhibits a heat absorbing function in the cooler 54 to cool the cooling vessel 42. Therefore, the cooling vessel 42 can be cooled at a desired temperature.

As described above, in the cooling heating device 1 of this embodiment, all of the units constituting the refrigerant circuit, and one control unit C1 which controls the operation of the cooling heating device 1 based on the cooling operation signal from the cooling load facility 22 and the heating operation signal from the heating load facility 23 are installed on one base to constitute one cooling heating unit 24. Therefore, the device can easily be connected to various cooling load facilities 22 and heating load facilities 23. Especially, since the load facility does not have to be connected via any refrigerant pipe, the cooling heating device 1 including the refrigerant circuit in which an appropriate amount of the refrigerant is introduced beforehand can be delivered to an installation place. Movement and installing work are facilitated, and the device has excellent general-purpose properties as compared with the cooling heating device of Embodiment 2.

Embodiment 4

Figure 8:
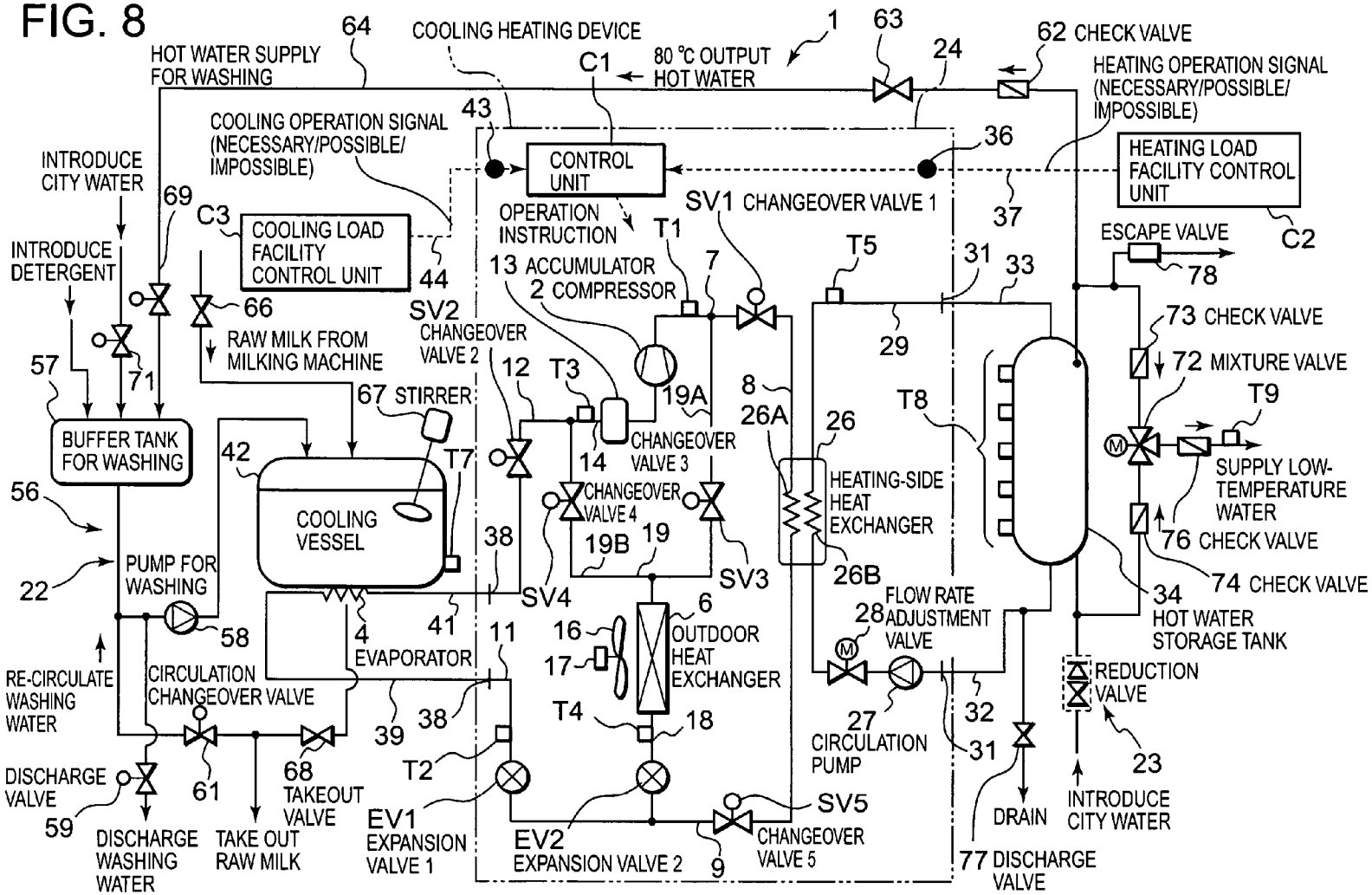
FIG. 8 is a circuit constitution diagram of a cooling heating device according to Embodiment 4 of the present invention.

Next, FIG. 8 shows a circuit diagram of a cooling heating device 1 according to Embodiment 4 of the present invention. In the cooling heating device 1 of this embodiment, a cooling heating unit 24 similar to that of Embodiment 2 described above is constituted. In this embodiment, a cooling vessel 42 in which beverage such as milk (the milk in the embodiment) is cooled and insulated is connected as a cooling load facility 22 to the cooling heating unit 24. As a heating load facility 23, a hot water supply facility including a hot water storage tank 34 is connected to the cooling heating unit 24.

In this drawing, reference numeral 56 is a cooling vessel washing device disposed in the cooling load facility 22. The device is constituted of a buffer tank 57 for washing into which a detergent is introduced and city water is introduced via an open/close valve 71; a pump 58 for washing; a discharge valve 59; a circulation changeover valve 61 and the like. Furthermore, high-temperature water for washing the cooling vessel 42 can be supplied from the hot water storage tank 34 of the hot water supply facility to the washing buffer tank 57 of the cooling vessel washing device 56 via a high-temperature water supply pipe 64 provided with a check valve 62 and open/close valves 63, 69.

Drawn milk is introduced into the cooling vessel 42 from a milking machine (not shown) via an open/close valve 66, and stirred by a stirrer 67. The milk cooled by a heat absorbing function of the refrigerant evaporated in an evaporator 4 as described above is taken out by opening a takeout valve 68 (the circulation changeover valve 61 is closed at this time). To wash the cooling vessel 42, the pump 58 for washing is operated, and the changeover valve 61 for circulation is opened to circulate the washing water having a high temperature though the cooling vessel 42 from the buffer tank 57 for washing. The washing water is discharged by opening the discharge valve 59.

On the other hand, in this case, hot water storage tank temperature sensors T8 are attached to a plurality of vertical portions of the hot water storage tank 34 of the heating load facility (the hot water supply facility) 23. Furthermore, the high-temperature water is taken from an upper portion of the hot water storage tank 34 to a mixture valve 72 via a check valve 73. The low-temperature water is taken from a lower portion of the tank to the mixture valve 72 via a check valve 74. The mixture valve 72 mixes the hot water, and the hot water is taken out via a check valve 76. In this case, a mixture ratio is adjusted based on a temperature detected by an output hot water temperature sensor T9 so as to have a desired output hot water temperature (from the low temperature to the high temperature). It is to be noted that reference numeral 78 is an escape valve which releases the pressure from the hot water storage tank 34, and 77 is a discharge valve of the hot water storage tank 34.

According to this embodiment, at the same time the milk as a cool target stored in the cooling vessel 42 is cooled, the water is boiled by effectively using the heat generated in a cooling process on a high-temperature side of the refrigeration cycle, and stored in the hot water storage tank 34. Moreover, the high-temperature output water suitable for the washing can be output by using a trans-critical cycle in which a carbon dioxide refrigerant is used. Therefore, this hot water can be used in washing the cooling vessel 42. Therefore, as compared with a conventional case where the water is boiled with a boiler or the like and supplied to an application of washing the cooling vessel 42, consumed energy can largely be reduced. Moreover, the heat released from the high-temperature side of the refrigeration cycle to the atmospheric air can be reduced. Therefore, rise of an ambient temperature can be suppressed.

Moreover, in this embodiment, an outdoor heat exchanger 6 is disposed in the same manner as in Embodiment 1. Therefore, in a case where the supply of the only hot water generated during the cooling of the cooling vessel 42 cannot cover a hot water supply load required for an application such as the washing application, when a hot water supply operation is performed using the atmospheric air as a heat source, the hot water can be generated to compensate for shortage. In consequence, an auxiliary boiler or the like for additional hot water supply is not required. Moreover, the hot water is highly efficiently supplied by a heat pump operation. Therefore, the energy consumption can further be reduced.

On the other hand, even in a case where an excessively large amount of the hot water is stored in the hot water storage tank 34 owing to a fluctuation of the amount of the milk as the cool target, a fluctuation of the hot water supply load and the like, the outdoor heat exchanger 6 can be used as a condenser of the refrigerant. Therefore, the cooling operation can securely be performed, and quality deterioration of the cool target due to a cooling defect can be prevented.

Moreover, according to the cooling heating device 1 of this embodiment, as described above, a control unit C1 determines a suitable operation mode so as to preferentially perform a simultaneous cooling and heating operation based on a cooling operation signal in response to a cooling load and a heating operation signal in response to a heating load. Therefore, an energy consumption efficiency improves, and the energy can effectively be used.

Furthermore, since the cooling heating unit 24 is installed on one base, as described above, a device installation work and a connection work to each load facility can easily be performed. For example, not only new installation but also reform of a part of the heating load facility 23, the cooling load facility 22 or the like after elapse of durable years can easily be performed.

It is to be noted that as inventions that can be grasped from the above description, in addition to inventions described in claims, the followings are considered:

That is, the cooling heating device characterized in that in the fourth or fifth invention, in a case where one of the cooling operation signal and the heating operation signal indicates a state in which the cooling or the heating is necessary and the other signal indicates a state in which the heating or the cooling is possible, the control means allows the channel changeover means to switch a channel so as to pass the refrigerant discharged from the compressor through the condenser and suck the refrigerant from the evaporator into the compressor;

the cooling heating device characterized in that in the above inventions, in the refrigerant circuit, carbon dioxide is introduced as the refrigerant, and a supercritical pressure is obtained on a high-pressure side;

a cooling load facility which is a cooling load facility connected as the cool target of the cooling heating device of the fourth invention and which comprises cooling-side signal output means for outputting the cooling operation signal; and a heating load facility which is a heating load facility connected as the heat target of the cooling heating device of the fifth invention and which comprises heating-side signal output means for outputting the heating operation signal.

The present invention is usable in another industrial field such as a cooling insulation device of beverage such as the milk and a hot water supply device for washing the cooling insulation device, a cooling heating device related to processing of food, an automatic dispenser, and an air conditioner in which the cooling and the heating are demanded.

What is claimed is:

1. A cooling heating device which is provided with a vapor compression type refrigeration cycle including a refrigerant circuit constituted by successively connecting a compressor, a condenser, throttle means and an evaporator and which heats a heat target by use of a heat radiating function of a refrigerant in the condenser and which cools a cool target by use of a heat absorbing function of the refrigerant in the evaporator, the device comprising:

an auxiliary heat exchanger having one end connected to a refrigerant outlet-side pipe of the condenser via the throttle means and having an other end connected to a suction-side pipe and a discharge-side pipe of the compressor and configured to perform heat exchange between the refrigerant and a heat source other than the heat target and the cool target;

channel changeover means for executing control so as to pass the refrigerant discharged from the compressor through the condenser or the auxiliary heat exchanger and supply the refrigerant from the auxiliary heat exchanger to the compressor or supply the refrigerant from the evaporator to the compressor;

control means for controlling the compressor, throttle means and the channel changeover means based on a cooling operation signal in response to a cooling load of the cool target and a heating operation signal in response to a heating load of the heat target;

heating-side pump means for circulating a heating-side heat medium to perform heat exchange between the condenser and the heating-side heat medium constituting the heat target;

heating-side flow rate adjustment means for adjusting a flow rate of the heating-side heat medium;

heating-side temperature detection means for detecting a temperature of the heating-side heat medium subjected to the heat exchange between the heating-side heat medium and the condenser; and a heating-side connection port to be connected to a circulation path of the heating-side heat medium.

2. The cooling heating device according to claim 1, further comprising:

cooling-side pump means for circulating a cooling-side heat medium to perform heat exchange between the evaporator and the cooling-side heat medium constituting the cool target;

cooling-side flow rate adjustment means for adjusting a flow rate of the cooling-side heat medium;

cooling-side temperature detection means for detecting a temperature of the cooling-side heat medium subjected to the heat exchange between the cooling-side heat medium and the evaporator; and a cooling-side connection port to be connected to a circulation path of the cooling-side heat medium.

3. The cooling heating device according to claim 1, wherein the cooling operation signal is a signal indicating one of a state in which the cooling of the cool target in the evaporator is necessary, a state in which the cooling is possible and a state in which the cooling is impossible.

4. The cooling heating device according to claim 1 , wherein the heating operation signal is a signal indicating one of a state in which the heating of the heat target in the condenser is necessary, a state in which the heating is possible and a state in which the heating is impossible.

* * * * *